US008726759B2

(12) United States Patent
Mannle

(10) Patent No.: US 8,726,759 B2
(45) Date of Patent: May 20, 2014

(54) PEDAL ARRANGEMENT WITH A STANDING PEDAL PIVOTING ABOUT A HORIZONTAL AXIS

(76) Inventor: Erik Mannle, Oberkirch (DE)

( * ) Notice: Subject to any disclaimer, the term of this patent is extended or adjusted under 35 U.S.C. 154(b) by 640 days.

(21) Appl. No.: 12/866,490

(22) PCT Filed: Aug. 28, 2009

(86) PCT No.: PCT/EP2009/006239

§ 371 (c)(1),
(2), (4) Date: Aug. 6, 2010

(87) PCT Pub. No.: WO2010/022956

PCT Pub. Date: Mar. 4, 2010

(65) Prior Publication Data

US 2010/0313700 A1 Dec. 16, 2010

(30) Foreign Application Priority Data

Aug. 30, 2008 (DE) ..... 10 2008 045 178

(51) Int. Cl.
*G05G 1/44* (2008.04)
*G05G 1/38* (2008.04)
*G05G 5/03* (2008.04)

(52) U.S. Cl.
CPC .. *G05G 1/38* (2013.01); *G05G 1/44* (2013.01); *G05G 5/03* (2013.01)
USPC ..... 74/512; 74/513; 74/514; 74/560

(58) Field of Classification Search
CPC ..... G05G 1/38
USPC ..... 74/512–514, 560
IPC ..... B60K 26/02
See application file for complete search history.

(56) References Cited

U.S. PATENT DOCUMENTS 5,666,860 A * 9/1997 Baumann et al. ..... 74/513
8,438,945 B2 * 5/2013 Kim et al. ..... 74/513

(Continued)

FOREIGN PATENT DOCUMENTS

DE 4407005 3/1995
DE 19536699 4/1997

(Continued)

OTHER PUBLICATIONS

Machine Translation of DE 44 07 005 C1, Beglar, Mar. 9, 1995.*

(Continued)

*Primary Examiner* — Vinh Luong
(74) *Attorney, Agent, or Firm* — Volpe and Koenig, P.C.

(57) ABSTRACT

A pedal arrangement (1) with a standing pedal (2) features a friction element (9) which can be pressed against a housing wall (8) of the housing (6) accommodating the associated parts; the friction element is formed by an actuating lever (10) with two lever arms (12 and 13) arranged on both sides of its pivot bearing (11). The actuating lever (10) cooperates simultaneously with one or a plurality of restoring springs or compression springs (7) which cause a backward adjustment of the actuating lever (10) after cessation or reduction of the force on the pedal (2) and via a transmission element (19) of the pedal (2). The actuating lever (10) or one of the lever arms thereof thus itself forms the friction element (9) which reduces the number of required parts.

18 Claims, 1 Drawing Sheet

(56) References Cited

U.S. PATENT DOCUMENTS

| | | | | |
|---|---|---|---|---|
| 2006/0185469 | A1* | 8/2006 | Schlabach | 74/560 |
| 2007/0193396 | A1 | 8/2007 | Schlabach | |
| 2007/0193401 | A1* | 8/2007 | Campbell | 74/560 |

FOREIGN PATENT DOCUMENTS

| | | | | | |
|---|---|---|---|---|---|
| DE | 10121317 | | 11/2002 | | |
| DE | 102006035882 | | 5/2008 | | |
| DE | 10 2008 018 140 | A1 * | 10/2009 | | B60K 26/02 |
| DE | 10 2009 032 664 | A1 * | 1/2011 | | B60K 26/02 |
| EP | 1 388 455 | A1 * | 8/2003 | | B60K 26/02 |
| WO | WO 2009/001188 | A2 * | 12/2008 | | G05G 1/38 |

OTHER PUBLICATIONS

English Abstract of EP 1 388 455 A1, Kuhn et al., Nov. 2, 2004.*
English Abstract of DE 10 2009 032 664 A1, Berglar, Jan. 13, 2011.*
English Abstract of DE 10 2008 018 140 A1, Oct. 15, 2009.*

* cited by examiner

PEDAL ARRANGEMENT WITH A STANDING PEDAL PIVOTING ABOUT A HORIZONTAL AXIS

BACKGROUND

The invention relates to a pedal arrangement, in particular, for vehicles or motor vehicles, with a standing pedal that is provided with a sensor that is connected to a device for generating a desired value signal, in particular, for a drive, and that is supported so that it can pivot on a horizontal pivot axis in the position of use, wherein this pivot axis is arranged at a distance to a pedal face that can be acted upon by a user, wherein the pivot axis for the standing pedal is arranged on or in a housing or housing-like carrier in which is located at least one friction element that can be pressed by one or more restoring springs against a stationary part or against a housing wall, wherein, in the housing, a pivoting activation lever is provided with two lever arms arranged on both sides of its pivot bearing, wherein a first lever arm is acted upon by the pedal—directly or indirectly—or attaches directly or indirectly to the pedal and the restoring spring is active on a second lever arm of the activation lever, and the axis of the pivot bearing of the activation lever extends parallel to the pivot axis of the standing pedal.

Such a pedal arrangement is described in DE 10 2006 035 882 B4 and has proven itself. For the friction element that is important for the function, in this known arrangement, an additional holder arranged on the activation lever is provided with a projection part whose region standing apart from the holder interacts with the stationary part or the housing wall with friction.

The invention is therefore based on the objective of creating a pedal arrangement of the type defined above that allows the holder with a projecting region and the friction element arranged on this region to be eliminated.

SUMMARY

The objective is met in a pedal arrangement as defined above in that the pivoting activation lever itself is constructed as a friction element and forms a friction contact over at least one part of its pivoting path on at least one inner side of the housing or housing-like carrier and that the restoring spring is arranged or mounted between a stop located on the lever arm of the activation lever and a position of the housing set apart from this stop in the extension direction of the spring, wherein the distance between the stop on the lever arm and the position for the pivoting of the pivot lever changes. Thus, the spring can perform its action and is tensioned by the pedal being pressed down for the pivoting of the pivot lever and causes the return when the pedal is relaxed or released.

Through this arrangement, a holder for the friction element and a part that projects from this holder and that carries the actual friction element can be eliminated, because the activation lever itself is used as the friction element. Thus it obtains an additional function.

Here it is useful when the outer side of this pivot lever extending approximately concentric to the pivot bearing of the activation lever forms a friction contact on a housing wall acting upon it at least in some regions and is movable along this wall. In this way, a relatively large friction face can be formed and utilized.

The stop for the compression spring can be the front end of the lever arm of the activation lever interacting with the spring. Thus, it is not necessary to provide a separate stop on this lever arm, which, however, would also be possible.

The front end of the lever arm used as a stop for the compression spring can run at an acute angle to a tangent on the outer side of this lever arm in the region of the front end. Thus, the front end stands at an angle and not radially relative to the arc-shaped housing wall that is used as a counter friction face, so that the compression spring can be mounted at a favorable angle between this front end and a position in the housing, in order to generate the best possible pressure effect for a tensioned spring.

The direction of the spring force of the compression spring on the slanted front end of the lever arm can have a force component that presses the outer side of the activation lever onto the housing wall. Thus, the spring causes not only the return of the pivot lever, but also cooperates for the generation of the friction force.

Here it is useful when the outer side of the activation lever or at least the outer side of the lever arm acted upon by the restoring spring and the housing wall contacted by this lever arm have a circular-arc-shaped profile in the displacement direction. Thus, the friction faces are adapted essentially to the movement of the activation lever and its lever arms for the adjustment relative to the pivot bearing.

Here, in the previously explained cases in which a restoring spring is mentioned, several such restoring springs could also be provided. In addition, the restoring spring could also be constructed as a tension spring, if it were mounted on the housing after the lever arm in the displacement direction of the lever arm.

It is especially favorable, however, when the position of the housing is constructed as a slanted face for supporting the restoring spring constructed as a compression spring, wherein this slanted face rises at an angle inward from the adjacent arc-shaped part of the housing wall such that it is arranged in at least one adjustment position of the activation lever and its slanted front face approximately parallel to this front face. Therefore, for the displacement of the pedal in the direction of a greater load and the associated displacement of the activation lever and its lever arm acting on the restoring spring or compression spring, the situation is produced that the two faces between which the restoring spring is mounted have the most favorable parallel arrangement relative to each other in any pedal position in which the spring can best exert its forces onto the lever arm in the restoring direction.

Here it is advantageous when the slanted end face of the activation lever and the slanted counter-support position provided in the housing for the compression spring when the pedal is pressed down, that is, the full-load position, are arranged approximately parallel to each other and have a small distance to each other, so that the compression spring located in-between has its greatest possible compression. Accordingly, in this position it also exerts the greatest possible force and indeed for the restoring movement of the lever arm and the pedal initially in the most favorable direction.

The lever arm of the activation lever interacting with the compression spring can be arranged so that it can pivot on the activation lever and can be connected via a hinge or a material weakening in the form of a film hinge to the activation lever, wherein the pivot axis for the lever arm is arranged parallel to that for the activation lever. Therefore, the force component originating from the restoring spring can be even more effective for generating a friction force between the activation lever or lever arm and the housing wall, because at least the lever arm acted upon directly by the spring can be better pressed against the housing wall than the counter friction face due to its relative capability for pivoting.

The counter friction surface of the housing with a circular-arc-shaped profile in its longitudinal section can be arranged eccentric to the center axis of the pivot bearing of the activation lever in the sense that the friction increases with increasing pivoting of the pedal. Thus, the impression is given to the user that when the pedal is pressed down, an increase in force proportional to the increase in load appears on the pedal. However, it is also possible to eliminate such a change or increase in the friction force during the activation of the pedal.

For the pressurization of the first lever arm of the activation lever that has a profile opposite the lever arm acted upon by the compression spring, a transmission element can be provided starting from the pedal that extends as a connection between the pedal and the lever arm of the activation lever and attaches to the activation lever and the pedal with a positive-fit or integral connection and, indeed, in the direction in which the activation lever is oriented in the connection region. Pressing down on the pedal thus produces, due to the transmission element, a corresponding extension movement of the lever arm that is therefore transmitted to the enter pivot lever and thus also to the second lever arm.

The positive-fit connection between the transmission element and the lever arm of the activation lever can be formed by a locking part of an insertion part located on the transmission element that can be locked or inserted into a fitting recess. Thus, this connection is active in two activation directions, so that forces can also be received in both directions of the pedal movements. For example, the pedal cannot be raised, even if contaminants block the return, without the activation lever actually being reset. Undesired separation or undesired lifting of the pedal from the activation lever and from the associated activation means is avoided in this way. Thus, it is also possible to provide the neutral stop acting directly on the lever arm on which the transmission element of the pedal is active. The neutral point is precise accordingly.

The positive-fit connection between the transmission element and the lever arm of the activation lever can be detachable. This simplifies repairs.

For good transmission with good movement of the interacting parts, it is advantageous when the transmission element is connected in an articulating fashion with the pedal and with the lever arm. In practice, the transmission element between the pedal and lever arm thus forms a couple whose parts can pivot about their respective pivot axes without this movement being negatively affected by the transmission element.

The engagement position of the transmission element on the one lever arm of the activation lever can be set farther away from the pivot axis of the pedal than the engagement position of the restoring or compression spring on the other lever arm of the activation lever. In other words, the lever arm acted upon by the compression spring and also the compression spring itself are preferably closer to the pivot axis of the pedal than the transmission element between the pedal and activation lever. Indeed, an inverse arrangement would also be possible, but in this way, more favorable lever and movement relationships and the pedal pivoting can allow a more precise dosing and adjustment of the respective partial load due to the longer lever arm with which force is applied on the transmission element.

It should also be mentioned that the transmission element could be constructed so wide in the extension direction of the axes of the pivot bearings that it covers the angular space between itself and the pivot axis of the pedal and at least essentially closes this space at the side. Thus, an additional function is obtained, because it can prevent any coarse parts from reaching under the pedal in its hinge region and from blocking the pedal movement.

Primarily for a combination of individual or several of the features and measures described above, a pedal arrangement is produced with a standing pedal that requires relatively few parts, because the component on which the restoring spring or the restoring springs attach and that transmits the respective pedal position using sensors is simultaneously constructed itself as a friction element.

BRIEF DESCRIPTION OF THE DRAWINGS

Below, one embodiment of the invention will be described in detail with reference to the drawing. Shown in a partial schematic diagram are.

DETAILED DESCRIPTION OF THE PREFERRED EMBODIMENTS

Figure 1:
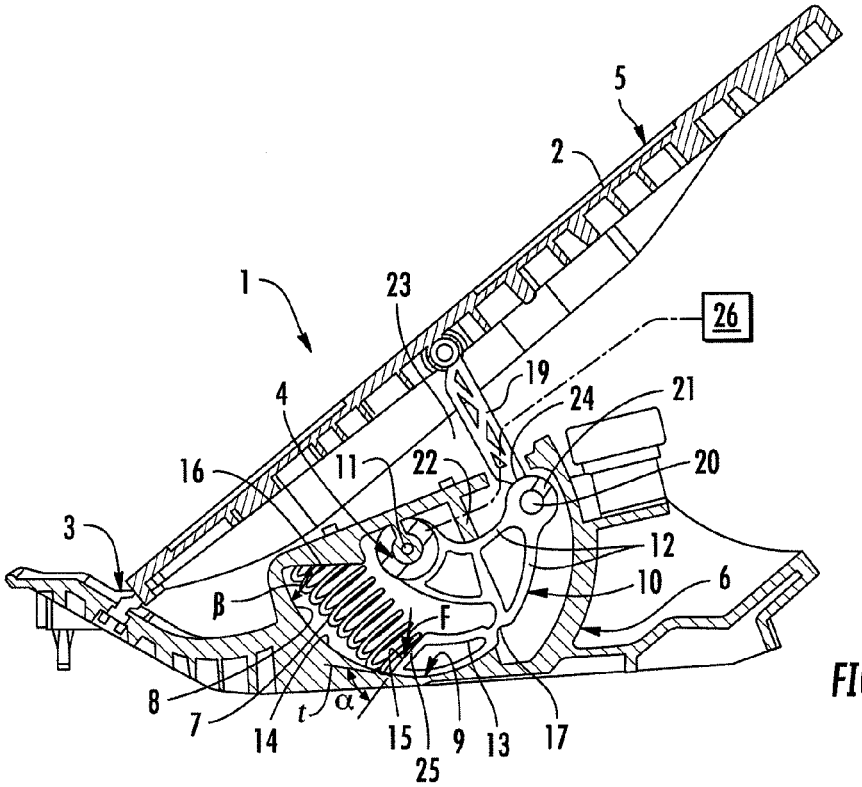
FIG. 1 is a longitudinal section view of a pedal arrangement according to the invention with a standing pedal that is located in its starting or rest position.

A pedal arrangement designated overall with 1 that can be provided primarily in vehicles or motor vehicles, but also in other applications so that a user can produce changes in speed with his or her foot has a standing pedal 2 whose pivot axis 3 is arranged deeper than the pedal projecting from it, so that the pedal 2 "stands" over the pivot axis 3. The inclination or the angle of the pedal 2 relative to a horizontal plane can here be different according to the vehicle type or application.

The pedal 2 is provided with a sensor that is designated overall with 4 and that corresponds approximately to the sensor 4 according to DE 10 2006 035 882 B4 and is connected to a known device that is not shown in detail, indicated at box 26, for generating a desired value signal, especially for a drive, and reacts to the respective pivoting of the pedal 2.

The pivot axis 3 for the pedal 2 is arranged at a distance to a pedal face 5 that can be acted upon by the user on or in a housing 6 in which a friction element 9 is provided that can be pressed against the housing wall 8 by a restoring spring 7 that is to be described in more detail below and that is constructed as a compression spring. Instead of a housing 6, a partially open housing-like carrier could also be provided.

In both figures, one sees that, in the housing 6, a pivoting activation lever designated overall with 10 is provided with two lever arms 12 and 13 arranged on both sides of its pivot bearing 11, wherein a first lever arm 12 is acted upon by the pedal 2 in a way still to be described. The restoring spring 7 attaches to a second lever arm 13 of the activation lever 10, as can be seen clearly in FIGS. 1 and 2. The axis of the pivot bearing 11 of the activation lever 10 here extends parallel to the pivot axis 3 of the standing pedal 2.

The pedal position sensor 4 provided on the pedal arrangement 1 is constructed in the embodiment as a rotational-angle sensor that is arranged or integrated on the activation lever 10 and here in a compact way on its pivot bearing 11, so that, on one hand, an economical rotational-angle sensor is used and this can also be accommodated without requiring significant additional space. Here, a rotating part of a non-contact magnetic sensor 4 can be supported advantageously so that it can rotate on the pivot bearing 11 of the activation lever 10 and the stationary part or stator of the sensor 4 can be connected to the housing 6, wherein these parts of the sensor can function in a non-contact fashion with each other, so that wear can also not gradually affect the function of the sensor 4 in a negative way.

By comparing FIGS. 1 and 2, it becomes clear that the pivoting activation lever 10 is constructed and is active itself as a friction element 9 at least in some sections or positions and forms a friction contact on an inside 14 of the housing 6 over at least one part of its pivoting path that extends between the two end positions of FIGS. 1 and 2 and that the restoring spring 7 is arranged and mounted between a stop 15 located on the lever arm 13 of the activation lever 10 and a position 16 of the housing 6 set apart from this stop in the extension direction of the spring 7, wherein the distance between the stop 15 and the position 16 for the pivoting of the pivot lever 10 is reduced from the position shown in FIG. 1 into the position visible in FIG. 2 and increased again for an opposite movement, that is, it changes when the pedal 2 is activated. The front end if the lever arm 13 used as the stop 15 for the compression spring 7 extends at an acute angle $\alpha$ to a tangent t on an outer side of the lever arm 13 in a region of the front end.

Figure 2:
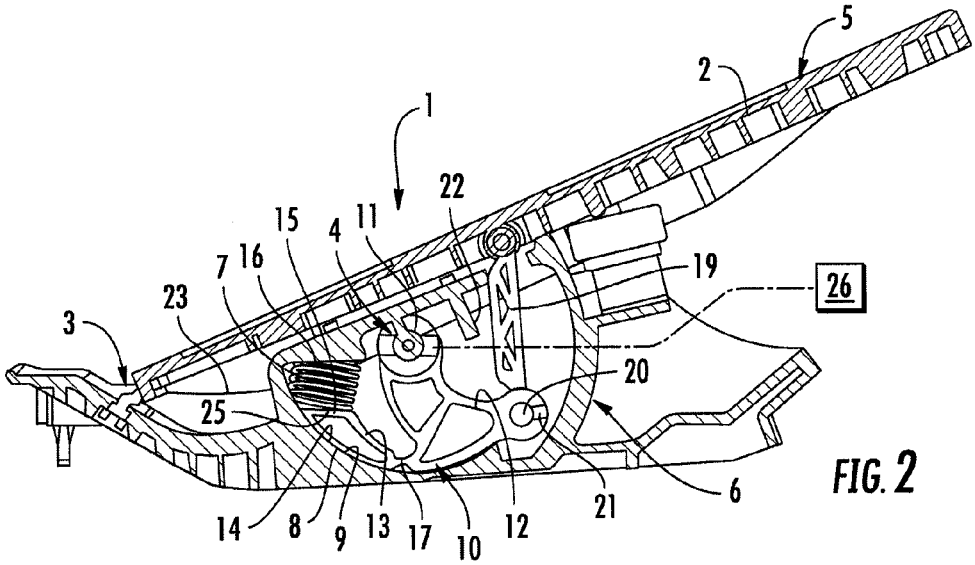
FIG. 2 is a view corresponding to FIG. 1, wherein the pedal is pivoted into its full-load position and therefore an activation lever belonging to the pedal arrangement is pivoted, and a restoring spring is tensioned.

From FIGS. 1 and 2 it becomes very clear that the restoring spring 7 resets the pedal again when the pressure on the pedal 2 is relaxed or released, as is known by users of such pedals.

The outer side of the activation lever 10 extends approximately concentric to its pivot bearing 11 and can move according to FIGS. 1 and 2 with friction along the housing wall 8 that it acts upon at least in some regions, that is, it contacts the housing wall 8 and can slide along this wall with friction when the pedal is activated. In this way, the pivoting activation lever 10 itself is used as a friction element 9, that is, it has a double function.

As a stop 15 for the restoring spring 7 constructed as a compression spring, the front end of the lever arm 13 interacting with this spring 7 is used, wherein this front end of the lever arm 13 acting as the stop 15 for the compression spring 7 extends at an acute angle to a tangent on the arc-shaped outer side of this lever arm 13 that could be contacted in the region of this front end. The acute angle is then located between the end side used as the stop 15 and the part of the tangent that extends in the direction of the lever arm 13, so that an angle projecting past the front end after the opposite side is obtuse.

The spring force of the compression spring 7 here has a force component F that presses the outer side of the activation lever 10 and primarily the lever arm 13 onto the housing wall 8, wherein a correspondingly large friction force is produced.

The outer side of the activation lever 10 and, in particular, the outer side of the lever arm 13 acted upon by the restoring spring 7 and the housing wall 8 contacted by this lever am have a circular-arc-shaped profile in the displacement direction, so that a corresponding movement of the activation lever 10 about its pivot bearing 11 is easily possible.

The position 16 of the housing 6 for supporting the restoring spring 7 is constructed in the embodiment as a slanted face that rises at an angle $\beta$ inward from the adjacent arc-shaped part of the housing wall 8 such that it is arranged approximately parallel to this end face acting as a stop 15 in at least one displacement position of the activation lever 10 and its slanted end face. Here, in FIG. 2 one sees that the slanted end face of the activation lever 10 and its lever arm 13 and the slanted counter-support position 16 provided in the housing 6 for the compression spring 7 are arranged approximately parallel to each other when the pedal 2 is pressed down, that is, in the full-load position, and have their smallest distance to each other, so that the restoring spring 7 located in-between has its greatest possible compression.

The lever arm 13 of the activation lever 10 interacting with the restoring spring 7 constructed as a helical spring is arranged so that it can pivot, on its side, on the activation lever 10 and is connected to the rest of the activation lever 10 by means of a hinge 17 that is, in the embodiment, a material weakening (indicated at 17 in FIG. 1) in the form of a film hinge. Here, the pivot axis of this hinge 18 for the lever arm 13 is arranged parallel to that for the activation lever 10 and also parallel to the pivot axis 3 of the pedal 2, so that the force of the restoring spring 7 can press the lever arm 13 relative to the rest of the activation arm 10 outward against the housing wall 8, in order to achieve the desired friction force with great certainty. Thus, primarily the lever arm 13 forms the friction element 9.

The counter friction face or housing wall 8 of the housing 6 with a circular-arc-shaped profile in longitudinal section is here arranged eccentric to the center axis of the pivot bearing 11 of the activation lever 10 in the sense that the friction increases with increasing pivoting of the pedal 2. Through simple geometric relationships, the friction force thus can be influenced in a desired way.

In both figures, one sees that for a force acting on the first lever arm 12 by the pedal 2, a transmission element 19 is provided that extends as a connection between the bottom side of the pedal 2 and the lever arm 12 of the activation lever 10 and attaches to the activation lever 12 and to the pedal with a positive-fit connection. Thus, the pedal 2 cannot be lifted from the housing, wherein contaminants can be prevented from entering into the region of the pivot axis 2.

The positive-fit connection between the transmission element 19 and the lever arm 12 of the activation lever 10 is formed by a suspension or locking or insertion part 20 that is located on the transmission element 19 and that can be locked or inserted in a fitting recess 21 and, indeed, at an angle that is greater than 90 degrees and thus prevents undesired unhinging. This positive-fit connection between the transmission element 19 and the lever arm 12, however, can be detached by an opposite unhinging movement.

The transmission element 19 is here connected in an articulating fashion to the pedal 2 and to the lever arm 12, thus, for the pivoting of the pedal 2 and the activation lever 10, on its side, corresponding compensation movements can be performed. The engagement position 24 of the transmission element 19 on the one lever arm 12 of the activation lever 10 is here set farther apart from the pivot axis 3 of the pedal 2 than the engagement position 25 of the restoring or compression spring 7 on the other lever arm 13, so that the pedal 2 can attach to the activation lever 10 at a correspondingly large distance from its pivot axis 3, that is, with favorable lever relationships.

It should also be mentioned that the rigid connection between the pedal 2 and lever arm 10 has the advantage that a neutral stop 22 can be provided acting directly on the second lever arm 12 and the neutral point is precise accordingly, because the starting position of the pedal 2 according to FIG. 1 is then simultaneously the neutral position. Here, the neutral stop 22 is arranged in the embodiment on the housing 6 adjacent to the pivot bearing 11 of the activation lever 10 between this pivot bearing 11 and the contact position of the transmission element 19, which also produces a compact construction and interacts with the lever arm 13 in the neutral position (FIG. 1).

It should also be mentioned that the transmission element 19 can be constructed so wide in the extension direction of the pivot axis 3 of the pedal 2 and the pivot bearing 11 that it covers and closes the angular space 23 (cf. FIG. 1) between itself and the pivot axis 3 of the pedal 2 at the side. Thus, large parts cannot be led from the free end of the pedal into this angular space 23 and cannot block the pedal movement.

The pedal arrangement 1 with a standing pedal 2 has a friction element 9 that can be pressed against a housing wall 8 of the housing holding the associated parts and that is formed by an activation lever 10 and, in particular, by one of two lever arms 12 and 13 belonging to it and arranged on both sides of its pivot bearing 11, wherein this activation lever 10 simultaneously interacts with one or several restoring springs or compression springs 7 that cause a return of the activation lever 10 and via a transmission element 19 of the pedal 2 when the force on the pedal 2 is relaxed or released. The activation lever 10 or one of its lever arms here forms itself the friction element 9, which reduces the number of parts that are required.

The invention claimed is:

1. A pedal arrangement (1) for vehicles or motor vehicles, comprising a standing pedal (2) provided with a sensor (4) that is connected to a device for generating a desired value signal for a drive, and that is supported so that the standing pedal is pivotable on a horizontal pivot axis (3) in a position of use, the pivot axis is arranged at a distance to a pedal surface that is adapted to be acted upon by a user, the pivot axis (3) for the standing pedal is arranged on or in a housing (6) or carrier in which at least one friction element (9) is located and is pressed by one or more restoring springs (7) against a stationary part or against a housing wall (8), the friction element comprises an activation lever (10) with first and second lever arms (12, 13) located on both sides of a pivot bearing (11) of the activation lever (10), the first lever arm (12) is acted upon by the pedal (2) or attaches to the pedal and the restoring spring (7) is active on the second lever arm (13) of the activation lever (10), and an axis of the pivot bearing (11) extends parallel to the pivot axis (3) of the standing pedal (2), the pivoting activation lever (10) forms a friction contact on at least one inner side (14) of the housing (6) over at least one part of a pivoting path thereof and the restoring spring (7) is arranged or mounted between a stop (15) located on the second lever arm (13) of the activation lever (10) and a counter-support position on the housing (6) spaced apart in an extension direction of the spring (7), and a distance between the stop (15) on the second lever arm (13) and the counter-support position (16) changes upon pivoting of the activation lever (10).

2. The pedal arrangement according to claim 1, wherein an outer side of the activation lever extending concentric to the pivot bearing (11) of the activation lever (10) forms a friction contact on the housing wall (8) acting upon at least some regions of the housing wall (8) and is movable along the housing wall.

3. The pedal arrangement according to claim 1, wherein the stop (15) for the restoring spring (7) is a front end of the second lever arm (13) of the activation lever interacting with the spring (7).

4. The pedal arrangement according to claim 3, wherein the front end of the second lever arm (13) used as the stop (15) for the compression spring (7) extends at an acute angle $\alpha$ to a tangent t on an outer side of the second lever arm (13) in a region of the front end.

5. The pedal arrangement according to claim 4, wherein a direction of the spring force of the compression spring (7) has a force component F that presses the outer side of the activation lever (10) onto the housing wall (8) via contact with a slanted front end of the activation lever (10).

6. The pedal arrangement according to claim 4, wherein the outer side of the activation lever (10) or at least an outer side of the second lever arm (13) acted upon by the restoring spring (7) and the housing wall (8) contacted by the lever arm have a circular-arc-shaped profile in a displacement direction.

7. The pedal arrangement according to claim 4, wherein the support position (16) of the housing (6) is constructed for supporting the restoring spring (7) has a slanted face that rises inward at an angle from an adjacent arc-shaped part of the housing wall (8) and is arranged such that in at least one displacement position of the activation lever (10), the slanted front end of the activation lever is approximately parallel to the slanted face.

8. The pedal arrangement according to claim 7, wherein the slanted front end of the activation lever (10) and the slanted face of the counter-support position (16) provided in the housing (6) for the compression spring (7) when the pedal (2) is pressed down in a full-load position, are arranged parallel to each other and have a smallest distance to each other, so that the restoring spring (7) located in-between has a greatest possible compression.

9. The pedal arrangement according to claim 1, wherein the second lever arm (13) of the activation lever (10) interacting with the compression spring (7) can pivot on the activation lever (10) and is connected to the activation lever (10) via a hinge (17) or a material weakening that forms a film hinge, a pivot axis of the hinge (17) for the second lever arm (13) is arranged parallel to the axis for the activation lever (10).

10. The pedal arrangement according to claim 1, wherein the friction face (8) of the housing (6) with a circular-arc shape in longitudinal section is arranged eccentric to the axis of the pivot bearing (11) of the activation lever (10) so that friction increases with increasing pivoting of the pedal (2).

11. The pedal arrangement according to claim 1, wherein for pressurization of the first lever arm (12) by the pedal (2), a transmission element (19) is provided that extends as a connection between the pedal (2) and the first lever arm (12) of the activation lever (10) and attaches to the activation lever (12) and to the pedal (2) with a positive-fit or integral connection.

12. The pedal arrangement according to claim 11, wherein the positive-fit connection between the transmission element (19) and the first lever arm (12) of the activation lever (10) is formed by a locking part or insertion part (20) that is located on the transmission element (19) and is one of inserted or locked into a fitting recess (21) of the activation lever (10).

13. The pedal arrangement according to claim 12, wherein the positive-fit connection between the transmission element (19) and the first lever arm (12) of the activation lever is a disengageable connection.

14. The pedal arrangement according to claim 11, wherein the transmission element (19) is connected in an articulated manner to the pedal (2) and to the first lever arm (12).

15. The pedal arrangement according to claim 11, wherein an engagement position (24) of the transmission element (19) on one of the lever arms (12) of the activation lever (10) is set farther apart from the pivot axis (3) of the pedal (2) than an engagement position (25) of the restoring or compression spring (7) on the other lever arm (13) of the activation lever (10).

16. The pedal arrangement according to claim 11, wherein the transmission element (19) is constructed having a width in an extension direction of the pivot axis (3) and the pivot bearing (11) that the transmission element (19) covers and closes an angular space (23) between itself and the pivot axis (3) of the pedal (2) at the side.

17. The pedal arrangement according to claim 11, wherein a neutral stop (22) is provided on the housing acting on the first lever arm (12).

18. The pedal arrangement according to claim 17, wherein the neutral stop (22) is arranged on the housing (6) adjacent to the pivot bearing (11) of the activation lever (10) between the pivot bearing (11) and the engagement position of the transmission element (19).

* * * * *